US012252307B1

(12) United States Patent
Li et al.

(10) Patent No.: US 12,252,307 B1
(45) Date of Patent: Mar. 18, 2025

(54) CONTAINER WITH SCRIM WINDOW

(71) Applicant: Milliken & Company, Spartanburg, SC (US)

(72) Inventors: Shulong Li, Spartanburg, SC (US); Richard A. Mayernik, Simpsonville, SC (US); Andrew Broadway, Fountain Inn, SC (US)

(73) Assignee: Milliken & Company, Spartanburg, SC (US)

( * ) Notice: Subject to any disclaimer, the term of this patent is extended or adjusted under 35 U.S.C. 154(b) by 401 days.

(21) Appl. No.: 17/718,890

(22) Filed: Apr. 12, 2022

(51) Int. Cl.
*B65D 5/42* (2006.01)
*B65D 5/468* (2006.01)
*B65D 65/46* (2006.01)

(52) U.S. Cl.
CPC ..... *B65D 5/4204* (2013.01); *B65D 5/4608* (2013.01); *B65D 65/466* (2013.01)

(58) Field of Classification Search
CPC .. B65D 5/4204; B65D 5/4608; B65D 65/466; B65D 33/04; B65D 29/00; B65D 33/01; B65D 85/07; B31B 70/826; B31B 70/83; B31B 2155/00; B31B 2170/20; B31B 70/62; B31B 50/82; B31B 70/82; B32B 5/02; B32B 5/024
USPC ..... 229/162.1, 103.2; 383/102, 106, 117, 383/109, 92; 428/131, 134, 34.3, 343; 442/1
See application file for complete search history.

(56) References Cited

U.S. PATENT DOCUMENTS

| | | | | |
|---|---|---|---|---|
| 2,739,755 | A * | 3/1956 | Ottinger | B65D 33/12 383/92 |
| 7,713,890 | B2 | 5/2010 | Vogt | |
| 7,914,635 | B2 | 3/2011 | Thompson | |
| 8,309,192 | B2 * | 11/2012 | Meseguer Huertas | B65D 29/00 383/14 |
| 10,041,207 | B2 | 8/2018 | Martin | |
| 10,072,419 | B2 | 9/2018 | Martin | |
| 10,562,659 | B2 * | 2/2020 | Fortin | D21H 27/16 |
| 11,897,226 | B2 * | 2/2024 | Resch | B65B 9/08 |
| 2002/0119281 | A1 | 8/2002 | Higgins | |
| 2003/0232161 | A1 | 12/2003 | Lin | |
| 2005/0186873 | A1 | 8/2005 | Wang | |
| 2010/0112881 | A1 | 5/2010 | Bahukudumbi | |
| 2021/0060888 | A1 | 3/2021 | Resch | |
| 2021/0285219 | A1 | 9/2021 | Wenstrup | |

* cited by examiner

*Primary Examiner* — Christopher R Demeree
(74) *Attorney, Agent, or Firm* — Cheryl J. Brickey

(57) ABSTRACT

A container is described having at least one sheet of paper folded and adhered to form a body defining an interior space. The body has an inner surface and an outer surface and contains at least one window portion in at least one of the sides. The window portion comprises a hole in the sheet of paper. The container further contains a textile material, where the textile material contains biodegradable yarns and an adhesive composition. The adhesive composition contains at least 50% by weight of a vinyl acetate ethylene co-polymer having a glass transition temperature of between about 10 and 30° C. The adhesive composition forms between about 20 to 60% by weight of the textile material. The textile material is adhered to the inner surface of the body at least in the window portion and completely overlaps the hole in the sheet of paper.

30 Claims, 1 Drawing Sheet

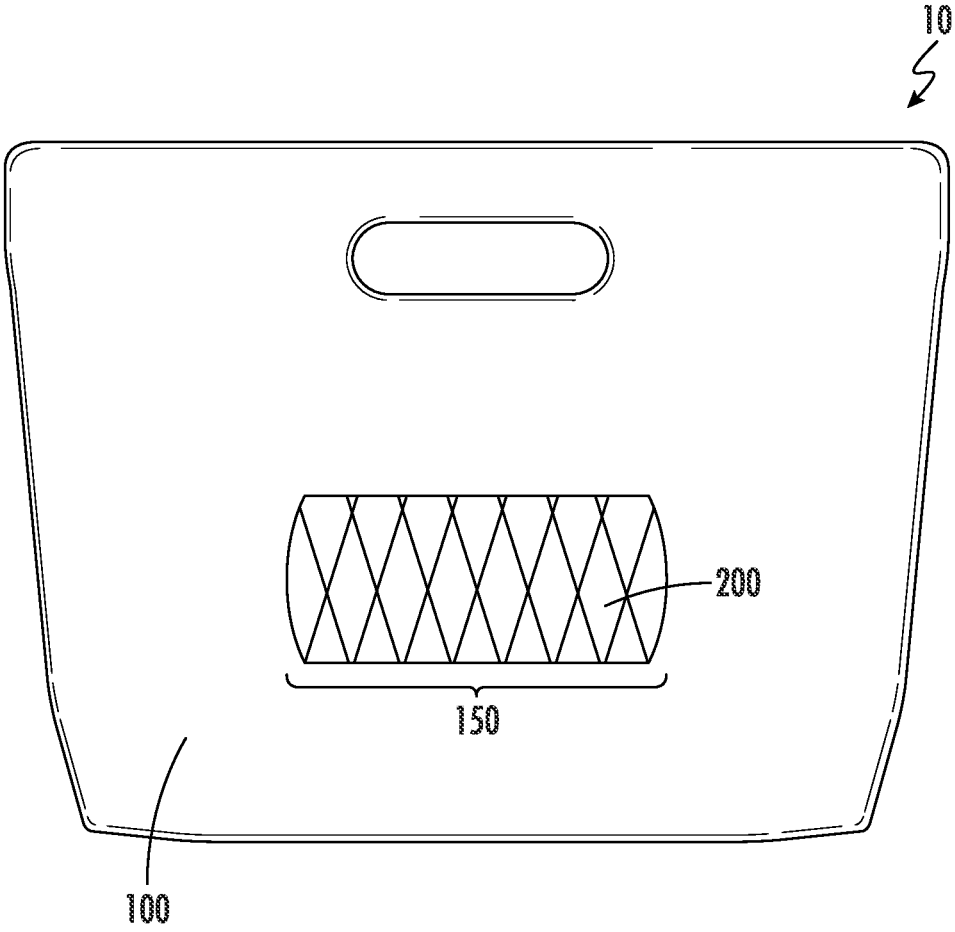
10
200
150
100

CONTAINER WITH SCRIM WINDOW

TECHNICAL FIELD

The present invention is directed to a container formed from paper that contains a textile covered window.

BACKGROUND

Most product and other food stuffs are sold today in plastic bags and containers. People and manufacturers are looking to move away from plastic packaging as the plastic pollution of the land and oceans worsen. There is a need for a biodegradable container that breaks down naturally in the environment.

One desired feature of a plastic container is that in many cases, the container can be clear or see through so that the items (such as product, cheese, etc) can easily been examined without opening the packing. A biodegradable container, such as made from paper, is opaque, which makes displaying the goods within the bag more challenging.

There is a need for a biodegradable container to have windows that are filled with an open biodegradable textile to allow the contents to be viewed. This textile must have good adhesion to the biodegradable container so that the textile does not fall out.

BRIEF SUMMARY OF THE INVENTION

A container is described having at least one sheet of paper folded and adhered together to form a body having at least two sides and defining an interior space. The body has an inner surface and an outer surface and contains at least one window portion in at least one of the sides. The window portion comprises a hole in the sheet of paper. The container further contains a textile material, where the textile material contains biodegradable yarns and an adhesive composition. The adhesive composition contains at least 50% by weight of a vinyl acetate ethylene co-polymer having a glass transition temperature of between about 10 and 30° C. The adhesive composition forms between about 20 to 60% by weight of the textile material. The textile material is adhered to the inner surface of the body at least in the window portion and completely overlaps the hole in the sheet of paper.

BRIEF DESCRIPTION OF THE DRAWINGS

The present invention is best understood with reference to the following detailed description of embodiments of the invention when read in conjunction with the attached drawings, in which like numerals refer to like elements, and in which:

FIG. 1 shows an illustration of one embodiment of the container.

DETAILED DESCRIPTION

The present invention relates to a biodegradable paper container for food stuffs and other good which can help reduce the plastic pollution problem in the planet. Referring to FIG. 1, there is shown one embodiment of a container according to the invention. Preferably, the entire container 10 (including the sheets of paper 100, scrim 200) and any other elements to the container are biodegradable. In one embodiment, the entire container 10 is pre-pulpable being defined as meeting the Voluntary Standard for Repulping and Recycling Corrugated Fiber Board developed by the Fibre Box Association. In another embodiment, the entire container is FDA compliant food safe.

The container 10 contains at least one sheet of paper 100 folded and adhered together to form a body having at least two sides and defining an interior space. The container 10 can have any suitable shape including, but not limited to, a pouch, carton, bag, box, cube, sack, and envelope. The container may be permanently sealed (meaning that at least a portion of the container would have to be ripped, cut, or destroyed to get at the contents), may be resealable closed (such as using hook and look attachments, resealable pressure sensitive adhesive, Zip-Lock type closures), or the container may have an opening without a sealant. The container 10 may also have additional features such as printing, colors, handles, and the like.

The container 10 has at least two sides such as an envelope, three sides such as a pouch or container shown in FIG. 1, or four or more sides such as a carton or box. The body of the container defines the interior space where the product is placed.

In one embodiment, the container 10 contains at least one sheet of paper 100 folded and adhered together to form a body. In another embodiment, the container contains at least two sheets of paper 100 folded and adhered together to form a body. It is desirable to limit the number of sheets of paper 100 used in the container for manufacturing cost and efficiency. In the container shown in FIG. 1, there are three sheets of paper 100 that make up the body of the container 10, a first forms the front side, a second forms the backside (not shown in the FIGURE), and a third forms the bottom (not shown in the FIGURE) so that the container can sit upright on a shelf.

The sheet of paper 100 used in the container may be any suitable sheet of paper. The thickness of the paper and any treatments on the paper are selected according to the end use. The heavier the paper weight, typically the heavier the items in the container can be. Further, the paper may contain additional additives or coatings to impart properties such as water resistance, water proofness, UV resistance, and stiffness. It is preferred that any additive added to the paper (within the paper or added as a coating or surface layer) also be biodegradable such that the entire container 10 can be biodegradable.

In one preferred embodiment, the paper forming inner surface of the body contains a coating of a resin comprising polyvinyl acetate homopolymer or vinyl acetate-ethylene copolymer. In another embodiment, both surfaces of the paper (forming the inner surface of the body and the outer surface of the body) contains a coating of a resin comprising polyvinyl acetate homopolymer or vinyl acetate-ethylene copolymer. This coating may be applied to the paper in any suitable manner such as dip coating, gravure coating, curtain coating, knit coating, and foam coating. It has been found a resin comprising polyvinyl acetate homopolymer or vinyl acetate-ethylene copolymer is biodegradable and also provides water resistance to the container 10.

The body of the container 10 has an inner surface and an outer surface and contains at least one window portion 150 in at least one of the sides, where this window portion is a hole in the sheet of paper 100. The window portion 150 is a hole completely through the thickness of the paper and is defined as the area in the sheet of paper where there is no paper. This window portion is important to the container 10 so that the consumer can see the goods within the container. The window portion 150 shape and size are selected according to the size of the container and the size/quality of goods inside of the container. For example, the container of FIG. 1 has a slightly rounded rectangle window portion shape, and the window is less than 25% of the area of one of the sides of the container. The shape may also be square, rectangular, triangular, circular, elliptical, star shapes, or any other shape. Preferably, the window portion's largest dimension is less than about 10 inches, more preferably less than 6 inches.

The container's window portion 150 provides viewing of the goods within the container, but the container preferably further contains a textile material 200 that completely overlaps the hole in the sheet of paper and is adhered to the inner surface of the body at least in the window portion. This textile material is preferably open, meaning that the yarns or fibers are spaced apart so that a consumer can at least partially see through the textile, but is closed enough such that the goods within the container do not fall out.

The textile material 200 may be any suitable textile material (structure and materials) including any suitable woven, knit, or nonwoven fabric. Preferably, the textile material 200 is a scrim textile as scrims are open, light weight, and inexpensive. The scrim textile may be a woven or knit scrim, preferably a weft inserted warp knit scrim. In other embodiments, the scrim textile is selected from a laid scrim, woven scrim, braid scrim, or knit scrim.

The textile material 200 contains a plurality of yarns (or fibers). Suitable yarns, include but are not limited to a spun staple yarn, a multifilament yarn, and/or a monofilament yarn. "Yarn", in this application, as used herein includes a monofilament elongated body, a multifilament elongated body, ribbon, strip, fiber, tape, and the like. The term yarn includes a plurality of any one or combination of the above. The yarns may be staple yarns are continuous multifilament yarns. Some suitable materials for the yarns include polyamide, aramids (including meta and para forms), rayon, PVA (polyvinyl alcohol), polyester, polyolefin, polyvinyl, nylon (including nylon 6, nylon 6, 6, and nylon 4,6), polyethylene naphthalate (PEN), cotton, steel, carbon, fiberglass, steel, polyacrylic or any other suitable artificial or natural fiber.

The yarns forming the textile material 200 preferably are biodegradable. In one embodiment, the yarns are cellulosic (cotton, rayon, lyocell, hemp, flax, and mixtures thereof). In another embodiment, the biodegradable fibers (forming the biodegradable yarns) comprise cellulose (slit paper) yarn, cellulose acetate, or polylactic acid.

The yarns/fibers making up the textile material 200 may be any suitable yarn or fiber. "Yarn", in this application, as used herein includes a monofilament elongated body, a multifilament elongated body, ribbon, strip, fiber, tape, and the like. The term yarn includes a plurality of any one or combination of the above. The yarns may be of any suitable form such as spun staple yarn, monofilament, or multifilament, single component, bi-component, or multi-component, continuous filament and have any suitable cross-section shape such as circular, multi-lobal, square or rectangular (tape), and oval. Some suitable materials for the yarns include aramid (including meta and para forms), polyester, polyolefin, nylon (including nylon 6, nylon 6,6, and nylon 4,6), steel, carbon, fiberglass, and polyethylene terephthalate (polyester or PET). In one preferred embodiment, the scrim contains polyester yarns. In another preferred embodiment, the scrim contains glass fibers.

The textile material 200 completely overlaps the hole in the sheet of paper and is adhered to the inner surface of the body at least in the window portion (and at least a small distance onto the sheet of paper so it has something to adhere to). Preferably, the textile material extends past the hole in the paper sheet onto the inner surface of the paper sheet at least 5 millimeters, more preferably between about 3 and 10 millimeters. The peel strength between the textile material and the inner surface of the body preferably is at least about 0.3 $lb_f$ such that the textile material will not debone, delaminate, or separate from the body until normal packaging, shipping, and use.

The textile material is adhered to the inner surface of the body through the use of an adhesive composition. The adhesive composition preferably contains at least 50% by weight of a vinyl acetate ethylene co-polymer which has a glass transition temperature of between about 10 and 30° C. In another embodiment, the vinyl acetate ethylene co-polymer contains at least about 70% by weight the vinyl acetate polymer or between about 80 and 90% by weight the vinyl acetate polymer. In one embodiment, the adhesive composition contains a colloidal stabilizer. The colloidal stabilizer is preferably polyvinyl alcohol. In another embodiment, the adhesive composition further contains a pigment.

The adhesive composition is preferably not only between the textile material and the body but also covers at least a portion of the textile material also. In one embodiment, the adhesive composition covers a majority of the surface of the biodegradable yarns. The adhesive composition may cover the outer surface of the yarns or may penetrate into the yarns and coat a portion of the surface area of the fibers within the yarns. The adhesive composition preferably forms between about 20 to 60% by weight of the textile material. The adhesive composition preferably forms between about 20 to 60% by weight of the textile material. In another embodiment, the adhesive composition preferably forms between about 25 to 52% by weight of the textile material.

EXAMPLES

A 100% viscose rayon staple fiber was spun into a 20 cotton count single ply yarn. The yarn was dipped into each of the following adhesive emulsions, then dried in a 270° F. convection oven to form an adhesive coated yarn with adhesive add-on of about 30-40% by weight of the base yarn. The yarn was pressed against a poly vinyl acetate coated paper at about 150-170° C. for 0.5-1.5 seconds. The adhesion strength was measured by peeling the yarn from the coated paper in a 180 degree T-peel configuration. The results of examples 1-5 are summarized below (VA=vinyl acetate, E=ethylene)

| Ex. | Chemical Composition | Polymer glass transition temp Tg | Estimated Monomer Compositions | Peel Strength | Flexibility |
|---|---|---|---|---|---|
| 1 | Vinyl acetate-ethylene copolymer | 18° C. | 90% VA, 10% E | 0.365 | relatively flexible |
| 2 | Vinyl acetate-ethylene copolymer | 11° C. | 80% VA, 20% E | 0.299 | relatively flexible |
| 4 | Vinyl acetate-ethylene copolymer | 0° C. | 70% VA, 30% E | 0.261 | flexible |
| 5 | Carboxylated vinyl acetate-ethylene copolymer | 0° C. | | 0.265 | flexible |

As can be seen in the table above, the peel strength between the textile material and the inner surface of the body is at least about 0.3 lbf when the adhesive composition comprises at least 50% by weight of a vinyl acetate ethylene co-polymer and the vinyl acetate ethylene co-polymer has a glass transition temperature of between about 10 and 30° C.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising at least one sheet of paper folded and adhered together to form a body having at least two sides and defining an interior space, wherein the body has an inner surface and an outer surface and comprises at least one window portion in at least one of the sides, wherein the window portion comprises a hole in the sheet of paper, wherein the container further comprises a textile material, wherein the textile material comprises biodegradable yarns and an adhesive composition, wherein the adhesive composition comprises at least 50% by weight of a vinyl acetate ethylene co-polymer, wherein the vinyl acetate ethylene co-polymer has a glass transition temperature of between about 10 and 30° C., wherein the adhesive composition forms between about 20 to 60% by weight of the textile material, wherein the textile material is adhered to the inner surface of the body at least in the window portion, wherein the textile material completely overlaps the hole in the sheet of paper, and wherein the peel strength between the textile material and the inner surface of the body is at least about 0.3 lbf.

2. The container of claim 1, wherein the biodegradable yarns are in a scrim.

3. The container of claim 2, wherein the scrim is selected from the group consisting of a laid scrim, a woven scrim, a braid scrim, and a knit scrim.

4. The container of claim 1, wherein the biodegradable yarns are in a woven, nonwoven, or knit textile.

5. The container of claim 1, wherein the container further comprises handles.

6. The container of claim 1, wherein the adhesive composition covers a majority of the surface of the biodegradable yarns.

7. The container of claim 1, wherein the biodegradable yarns comprise a cellulosic material selected fem from the group consisting of cotton, rayon, lyocell, hemp, and flax fiber.

8. The container of claim 1, wherein the biodegradable yarns comprise cellulose acetate or polylactic acid.

9. The container of claim 1, wherein the biodegradable yarns comprise continuous filament fibers.

10. The container of claim 1, wherein the biodegradable yarns comprise staple fibers.

11. The container of claim 1, wherein the adhesive composition further comprises a colloidal stabilizer.

12. The container of claim 11, wherein the colloidal stabilizer comprises polyvinyl alcohol.

13. The container of claim 1, wherein the adhesive composition further comprises a pigment.

14. The container of claim 1, wherein the sheet of paper forming the inner surface of the body comprises a coating of a resin comprising polyvinyl acetate homopolymer or vinyl acetate-ethylene copolymer.

15. The container of claim 1, wherein the entire container is pre-pulpable being defined as meeting the Voluntary Standard for Repulping and Recycling Corrugated Fiber Board developed by the Fibre Box Association.

16. The container of claim 1, wherein the entire container is FDA compliant food safe.

17. The container of claim 1, wherein the textile material extends past the hole in the paper sheet onto the inner surface of the paper sheet at least 5 millimeters.

18. A container comprising at least one sheet of paper folded and adhered together to form a body having at least two sides and defining an interior space, wherein the body has an inner surface and an outer surface and comprises at least one window portion in at least one of the sides, wherein the window portion comprises a hole in the sheet of paper, wherein the container further comprises a textile material, wherein the textile material comprises biodegradable yarns and an adhesive composition, wherein the adhesive composition comprises at least 50% by weight of a vinyl acetate ethylene co-polymer, wherein the vinyl acetate ethylene co-polymer has a glass transition temperature of between about 10 and 30° C., wherein the adhesive composition forms between about 20 to 60% by weight of the textile material, and wherein the vinyl acetate ethylene co-polymer comprises at least about 70% by weight the vinyl acetate polymer;

wherein the textile material is adhered to the inner surface of the body at least in the window portion, wherein the textile material completely overlaps the hole in the sheet of paper.

19. The container of claim 18, wherein the biodegradable yarns are in a scrim.

20. The container of claim 18, wherein the biodegradable yarns comprise a cellulosic material selected from the group consisting of cotton, rayon, lyocell, hemp, and flax fiber.

21. The container of claim 18, wherein the adhesive composition further comprises a colloidal stabilizer which comprises polyvinyl alcohol.

22. The container of claim 18, wherein the entire container is pre-pulpable being defined as meeting the Voluntary Standard for Repulping and Recycling Corrugated Fiber Board developed by the Fibre Box Association.

23. The container of claim 18, wherein the entire container is FDA compliant food safe.

24. The container of claim 18, wherein the peel strength between the textile material and the inner surface of the body is at least about 0.3 lbf.

25. A container comprising at least one sheet of paper folded and adhered together to form a body having at least two sides and defining an interior space, wherein the body has an inner surface and an outer surface and comprises at least one window portion in at least one of the sides, wherein the window portion comprises a hole in the sheet of paper, wherein the container further comprises a textile material, wherein the textile material comprises biodegradable yarns and an adhesive composition, wherein the adhesive composition comprises at least 50% by weight of a vinyl acetate ethylene co-polymer, wherein the vinyl acetate ethylene co-polymer has a glass transition temperature of between about 10 and 30° C., wherein the adhesive composition forms between about 20 to 60% by weight of the textile material, and wherein the vinyl acetate ethylene co-polymer comprises between about 80 and 90% by weight the vinyl acetate polymer;

wherein the textile material is adhered to the inner surface of the body at least in the window portion, wherein the textile material completely overlaps the hole in the sheet of paper.

26. The container of claim 25, wherein the biodegradable yarns are in a scrim.

27. The container of claim 25, wherein the biodegradable yarns comprise a cellulosic material selected from the group consisting of cotton, rayon, lyocell, hemp, and flax fiber.

28. The container of claim 25, wherein the adhesive composition further comprises a colloidal stabilizer which comprises polyvinyl alcohol.

29. The container of claim 25, wherein the entire container is pre-pulpable being defined as meeting the Voluntary Standard for Repulping and Recycling Corrugated Fiber Board developed by the Fibre Box Association.

30. The container of claim 25, wherein the entire container is FDA compliant food safe.

* * * * *